US006150775A

United States Patent [19]

Kau

[11] Patent Number: 6,150,775

[45] Date of Patent: Nov. 21, 2000

[54] CONTACT ACTUATED LAMP

[76] Inventor: Steven Kau, 6F, No. 440-2, Gin Pin Road, Chong Ho City, Taipei Hsien 235, Taiwan

[21] Appl. No.: 09/438,279

[22] Filed: Nov. 12, 1999

[51] Int. Cl.[7] ..... G05F 1/00

[52] U.S. Cl. ..... 315/308; 315/292; 315/312; 315/315; 315/DIG. 4

[58] Field of Search ..... 315/291, 307, 315/308, 292, 312, 316, 315, 200 A, DIG. 4

[56] References Cited

U.S. PATENT DOCUMENTS 4,525,651 6/1985 Ahlgren ..... 315/240
4,593,232 6/1986 McEdwards ..... 315/199
5,010,459 4/1991 Taylor et al. ..... 315/316 X
5,128,595 7/1992 Hara ..... 315/312

*Primary Examiner*—Haissa Philogene

[57] ABSTRACT

A lamp device includes an oscillating circuit and a brightness control circuit coupled to the lamp member. The brightness control circuit has two or more capacitors of different capacitances for energizing the lamp device to different brightnesses. A contacting control circuit is coupled to the brightness control circuit via an integrated circuit for actuating the lamp device via the integrated circuit by contacting a terminal of the contacting control circuit. A switching circuit is coupled to the brightness control circuit for selectively actuating the capacitors.

10 Claims, 3 Drawing Sheets

CONTACT ACTUATED LAMP

BACKGROUND OF THE INVENTION

1. Field of the Invention

The present invention relates to a lamp, and more particularly to a lamp actuated by contacting with the lamp.

2. Description of the Prior Art

Typical lamps may be actuated and controlled by flip-flop devices and by contacting the lamps.

The present invention has arisen to provide a lamp actuated with a novel actuating and contact controlling circuit for actuating the lamp by contacting with the lamp.

SUMMARY OF THE INVENTION

The primary objective of the present invention is to provide a lamp device having a circuit for allowing the lamp to be actuated by contacting with the lamp.

In accordance with one aspect of the invention, there is provided a lamp device comprising a lamp member, a first oscillating circuit coupled to the lamp member to actuate the lamp member, a brightness control circuit coupled to the lamp member, the brightness control circuit including at least two capacitors of different capacitances, an integrated circuit including a first terminal coupled to the brightness control circuit for outputting a signal to the brightness control circuit via the first terminal thereof, means for selectively actuating the capacitors to energize the lamp member and to control a brightness of the lamp member, and a contacting control circuit coupled to the integrated circuit, the contacting control circuit including a terminal for actuating the integrated circuit by contacting with the terminal of the contacting control circuit.

A rectifying circuit is further provided and coupled to the first oscillating circuit for converting an incoming AC current to a DC current and for providing the DC current to the first oscillating circuit. A stabilizing circuit is further provided and coupled between the rectifying circuit and the first oscillating circuit for stabilizing the current and for providing the stabilized current to the first oscillating circuit. The first oscillating circuit includes two transistors to be actuated alternatively to generate an oscillating signal.

A second oscillating circuit is further provided and coupled between the lamp member and the first oscillating circuit. The second oscillating circuit is preferably an inductance-capacitance oscillating circuit. A switching circuit is further provided and coupled between the integrated circuit and the brightness control circuit for selectively actuating the capacitors respectively.

The contact controlling circuit includes a transistor coupled between the terminal of the contact controlling circuit and the integrated circuit to actuate the integrated circuit when the terminal of the contact controlling circuit is contacted by a user. The lamp device includes a base coupled to the terminal of the contact controlling circuit for allowing the terminal of the contact controlling circuit to be actuated via the base of the lamp device. An indicating circuit is further provided for indicating a location of the base of the lamp device.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
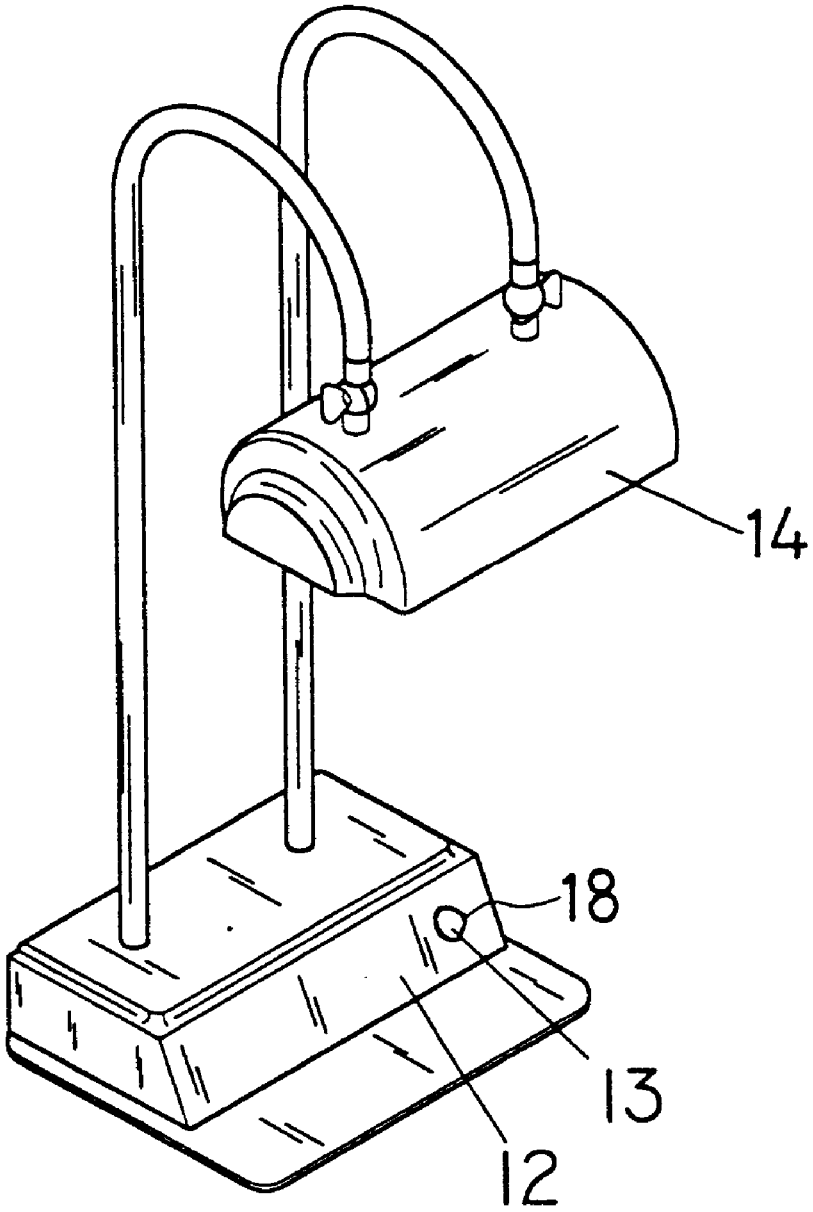
FIG. 1 is a perspective view of a lamp device in accordance with the present invention.

Referring to the drawings, and initially to FIG. 1, a lamp device in accordance with the present invention comprises a lamp member such as one or more light tubes 5 (FIG. 3) supported on a base 12 and shielded with a lamp shade 14, and a window or a transparent or semi-transparent member 13 disposed in the base 12 and having a diode 18, such as a light emitting diode (FIG. 3) disposed therein.

Figure 2:
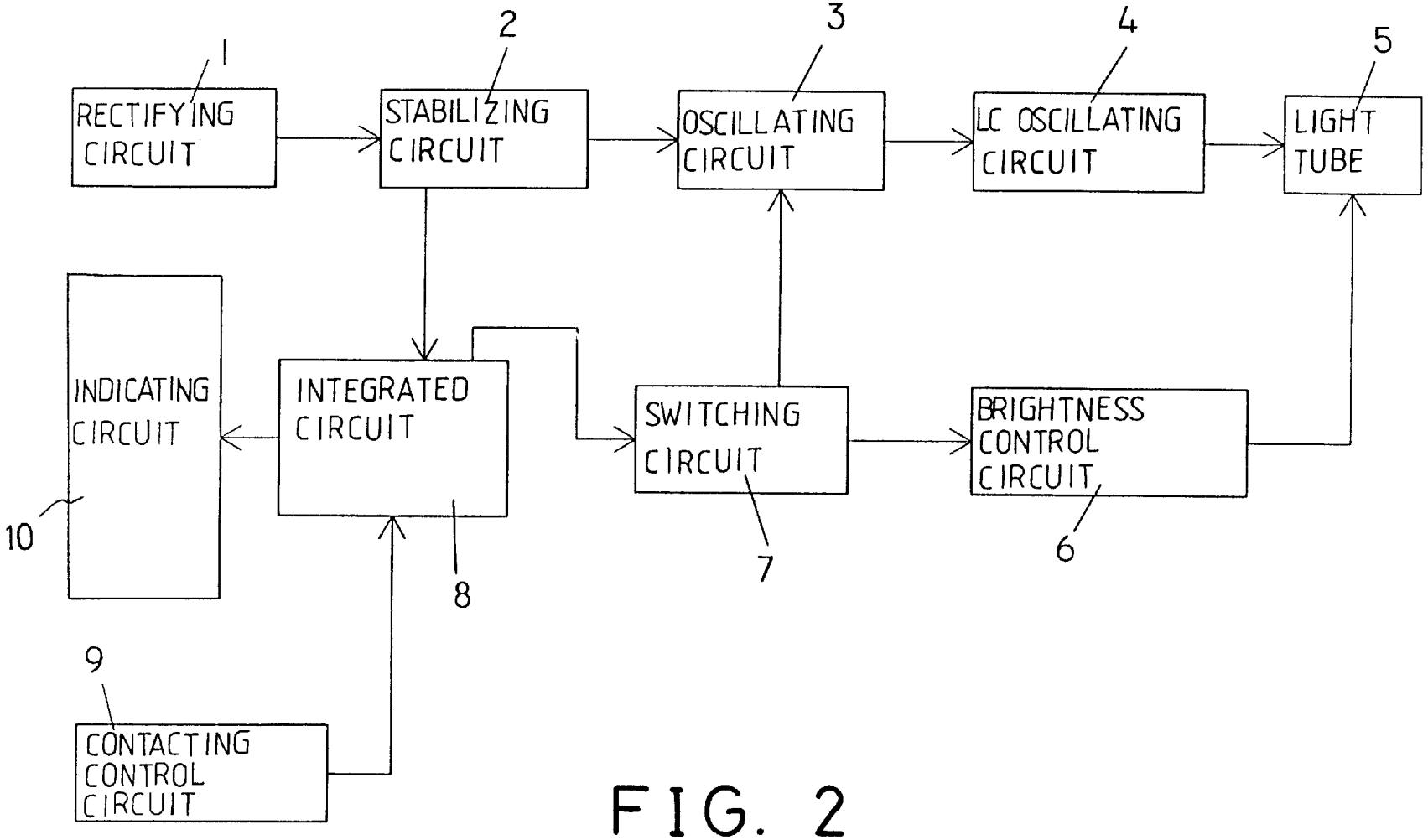
FIG. 2 is a block diagram illustrating the circuits for the lamp device.
Figure 3:
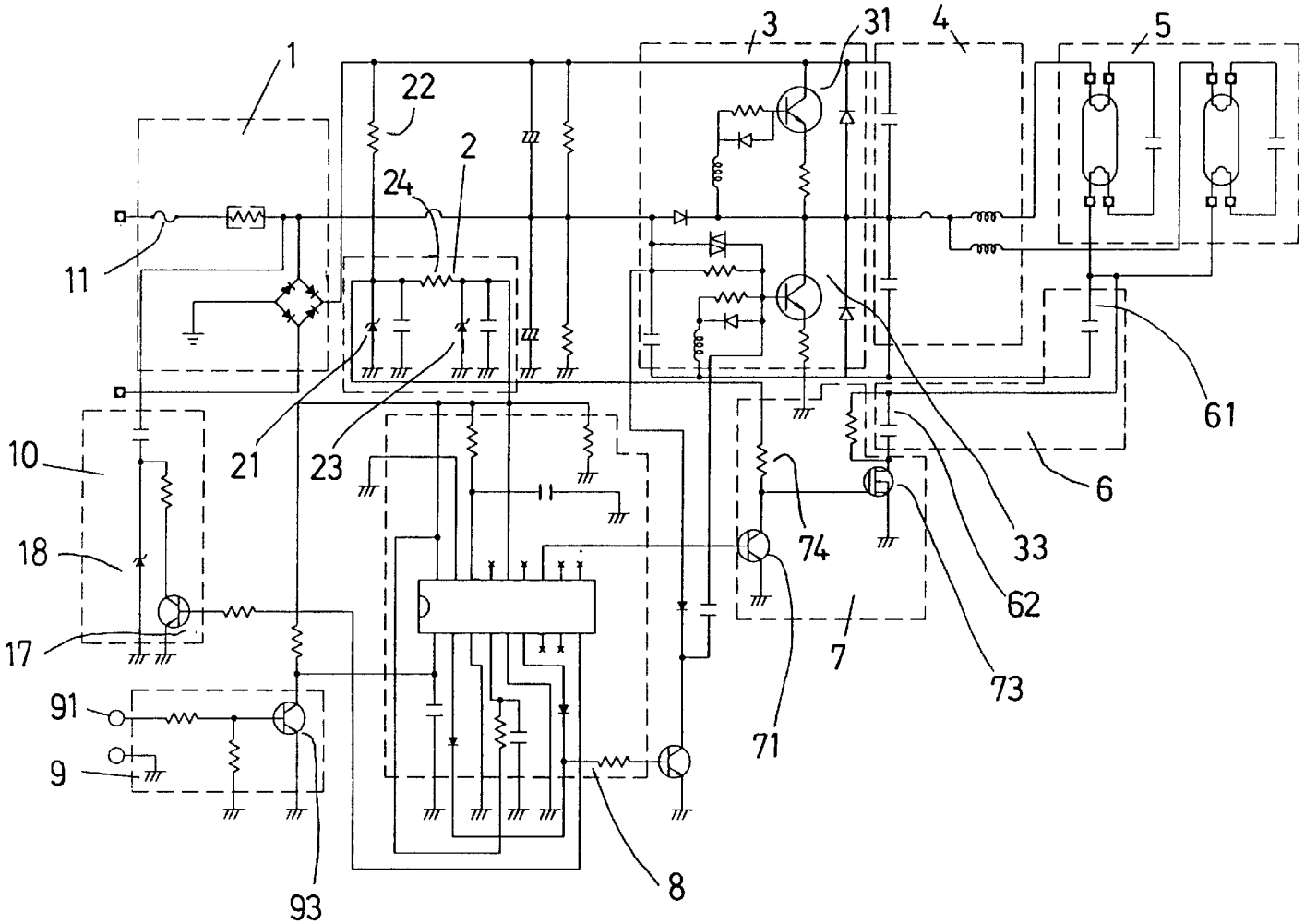
FIG. 3 is an electric circuit for the lamp device.

Referring next to FIGS. 2 and 3, the lamp device includes a rectifying circuit 1 coupled to an oscillating circuit 3 via a stabilizing circuit 2. The rectifying circuit 1 is provided for rectifying the incoming AC current to direct current (DC), such as a 12V DC current. The stabilizing circuit 2 includes a diode, such as a zener diode 21 coupled to a resistor 22 for stabilizing the DC current from the resistor 22 and for supplying the stabilized DC current to the oscillating circuit 3. The stabilizing circuit 2 preferably further includes a resistor 24 coupled to the resistor 22 in series for separating a current of a lower voltage, such as 5V, and another diode 23 coupled to the resistor 24 for stabilizing the 5V DC current and for supplying the stabilized DC current to the oscillating circuit 3. The stabilized DC current is also supplied to a terminal of an integrated circuit 8. The rectifying circuit 1 is coupled to an electric power supply, particularly an alternating current (AC) power supply via one or more fuses 11 which are provided for safety purposes as that of the typical lamp devices. The oscillating circuit 3 includes two transistors 31, 33 which may be operated or actuated respectively and alternatively to generate an oscillating output signal. Another oscillating circuit 4, such as an inductance-capacitance (LC) oscillating circuit, is coupled between the lamp member 5 and the oscillating circuit 3 for converting the frequency of the oscillating output signal from the oscillating circuit 3 to a higher frequency DC current which may be used to energize the lamp member 5.

A switching circuit 7 and a brightness control circuit 6 are coupled between the lamp device 5 and the integrated circuit 8, such as a programmable or programmed integrated circuit. The switching circuit 7 includes a transistor 71 coupled to one terminal of the integrated circuit 8 and includes a resistor 74 and a transistor 73 coupled to the transistor 71 for allowing the transistor 73 to be actuated via the resistor 74. The transistor 73 is preferably a MOSFET transistor. The brightness control circuit 6 includes two or more capacitors 61, 62 of different capacitances for generating currents of different frequencies and for controlling the brightness of the light tubes of the lamp device 5. The transistors 71, 73 of the switching circuit 7 may be used to actuate the capacitors 61, 62 respectively in order to control the brightness of the lamp device 5.

A contact controlling circuit 9 and an indicating circuit 10 are coupled to two different terminals of the integrated circuit 8. The contact controlling circuit 9 includes a terminal 91 coupled to the base 12 of the lamp device, for example, and a transistor 93 coupled to the terminal 91 thereof. The users may generate a 60 Hz current which may be used to actuate the transistor 93 when the user contacts the terminal 91 of the contact controlling circuit 9 via the base 12. When the transistor 93 of the contact controlling circuit 9 is actuated by the user by contacting with the base 12, the integrated circuit 8 may be actuated by the programs that are recorded in the integrated circuit 8 and may generate different output signals, such as a Hi, a Lo, an Off, and the other signals, to the switching circuit 7 in order to control or to adjust the brightness of the lamp device 5 via the capacitors 61, 62 of the brightness control circuit.

In operation, when the terminal 91 of the contacting control circuit 9 is actuated by contacting the base 12, the integrated circuit 8 may generate an output signal, for example the Hi signal, to the switching circuit 7 and to actuate the transistor 71 of the switching circuit 7 and to energize the lamp device 5 via the capacitor 61 of the brightness control circuit 6 which includes a greater capacitance such that the lamp device 5 may be energized to a greater brightness.

When the terminal 91 of the contacting control circuit 9 is actuated by contacting the base 12 again, the integrated circuit 8 may generate another output signal, for example the Lo signal, to the switching circuit 7. At this moment, the transistor 71 of the switching circuit 7 is switched off or is not energized. The other transistor (MOSFET) 73 of the switching circuit 7 will be actuated by the 12V current from the rectifying circuit 1 via the resistor 74, in order to energize the lamp device 5 via the capacitor 62 of the brightness control circuit 6 which includes a smaller capacitance such that the lamp device 5 may be energized to a less brightness.

When the terminal 91 of the contacting control circuit 9 is actuated by contacting the base 12 again, the integrated circuit 8 may generate a further output signal, for example the Off signal, to the switching circuit 7. At this moment, the switching circuit 7 is switched off or is not energized, and the oscillating circuit 3 is also switched off or cut off such that the lamp device 5 will not be energized at this moment. At this moment, the transistor 17 of the indicating circuit 10 will be actuated to energize the light emitting diode 18 and to light the environment or the location of the base 12, for allowing the users to easily contact the base 12 to switch on the lamp device 5 again.

It is to be noted that the lamp device 5 may thus be energized and controlled by the capacitors 61, 62 of different capacitances, and may be actuated by contacting with the base 12. The integrated circuit 8 may be programmed to generate the other output signals for controlling the lamp device 5 to the other different brightnesses.

Accordingly, the lamp device in accordance with the present invention includes a circuit for allowing the lamp to be actuated by contacting with the lamp.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp device comprising:

a) a lamp member, b) a first oscillating circuit coupled to said lamp member to actuate said lamp member, c) a brightness control circuit coupled to said lamp member, said brightness control circuit including at least two capacitors of different capacitances, d) an integrated circuit including a first terminal coupled to said brightness control circuit for outputting a signal to said brightness control circuit via said first terminal thereof, e) means for selectively actuating said at least two capacitors to energize said lamp member and to control a brightness of said lamp member, and f) a contacting control circuit coupled to said integrated circuit, said contacting control circuit including a terminal for actuating said integrated circuit by contacting with said terminal of said contacting control circuit.

2. The lamp device according to claim 1 further comprising a rectifying circuit coupled to said first oscillating circuit for converting an incoming AC current to a DC current and for providing the DC current to said first oscillating circuit.

3. The lamp device according to claim 2 further comprising a stabilizing circuit coupled between said rectifying circuit and said first oscillating circuit for stabilizing the current and for providing the stabilized current to said first oscillating circuit.

4. The lamp device according to claim 1, wherein said first oscillating circuit includes two transistors to be actuated alternatively to generate an oscillating signal.

5. The lamp device according to claim 1 further comprising a second oscillating circuit coupled between said lamp member and said first oscillating circuit.

6. The lamp device according to claim 5, wherein said second oscillating circuit is an inductance-capacitance oscillating circuit.

7. The lamp device according to claim 1 further comprising a switching circuit coupled between said integrated circuit and said brightness control circuit for selectively actuating said at least two capacitors respectively.

8. The lamp device according to claim 1, wherein said contact controlling circuit includes a transistor coupled between said terminal of said contact controlling circuit and said integrated circuit to actuate said integrated circuit when said terminal of said contact controlling circuit is contacted by a user.

9. The lamp device according to claim 8, wherein said lamp device includes a base coupled to said terminal of said contact controlling circuit for allowing said terminal of said contact controlling circuit to be actuated via said base of said lamp device.

10. The lamp device according to claim 9 further comprising an indicating circuit for indicating a location of said base of said lamp device.

* * * * *